United States Patent [19]

Beisel

[11] 3,996,856

[45] Dec. 14, 1976

[54] DEVICE FOR CONTROLLING THE DOCTOR ROLLER OF A PRINTING PRESS

[75] Inventor: Hermann Beisel, Walldorf, Germany

[73] Assignee: Heidelberger Druckmaschinen Aktiengesellschaft, Heidelberg, Germany

[22] Filed: July 31, 1974

[21] Appl. No.: 493,385

[30] Foreign Application Priority Data

July 31, 1973 Germany ..... 2338743

[52] U.S. Cl. ..... 101/350; 101/349; 101/364; 74/126

[51] Int. Cl.[2] ..... B41F 31/14; B41F 31/30; B41L 27/36

[58] Field of Search ..... 101/364, 363, 348–350; 74/88, 126

[56] References Cited

UNITED STATES PATENTS

| | | | |
|---|---|---|---|
| 2,728,292 | 12/1955 | Harless et al. | 101/363 |
| 3,552,312 | 1/1971 | Schinke et al. | 101/363 |
| 3,658,001 | 4/1972 | Sebold | 101/363 |

*Primary Examiner*—Edgar S. Burr
*Assistant Examiner*—William Pieprz
*Attorney, Agent, or Firm*—Herbert L. Lerner

[57] ABSTRACT

Device for controlling the doctor roller of a printing press includes a control gear segment rotatably mounted on a reciprocating control lever, a transmission gear segment mounted on a journal pin for the doctor roller and couplable in one direction, and a control disc member formed of an adjustable guide cam and a cam follower mounted on the control gear segment and guidably movable in the guide cam.

7 Claims, 4 Drawing Figures

Fig. 1
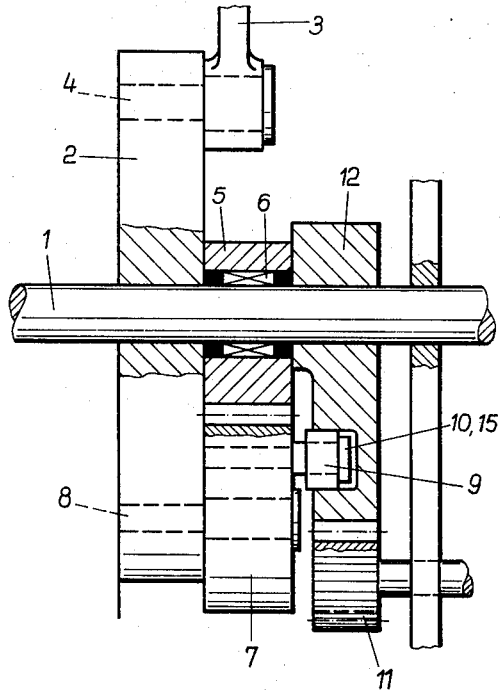
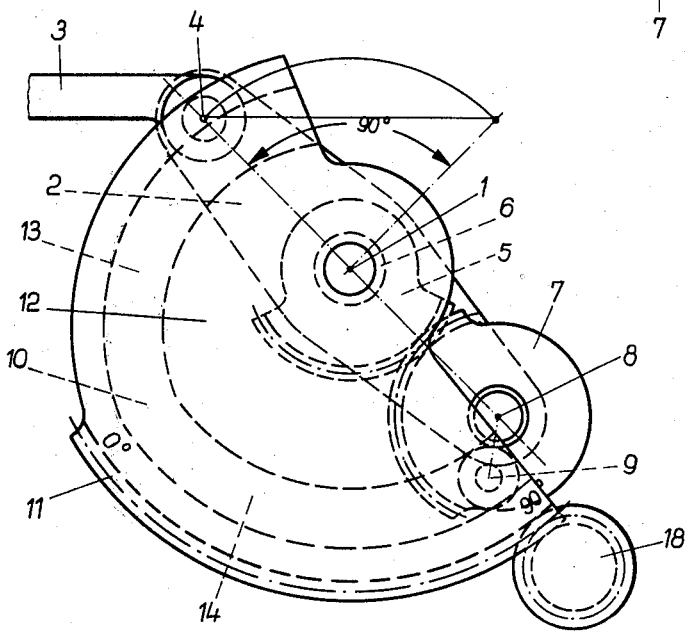
Fig. 2

DEVICE FOR CONTROLLING THE DOCTOR ROLLER OF A PRINTING PRESS

The invention relates to a device for controlling the doctor roller of a printing press.

It has been known heretofore from German Pat. No. 1 250 452 to provide a drive for an inking roller which comprises a planetary gear system having planetary gears which roll around by means of a bar or strap connected to a reciprocating rocker arm between an internally toothed outer gear and an externally toothed inner gear mounted on the inking roller through the intermediary of a free-wheeling coupling, the internally toothed outer gear being connected to a stop or abutment member which is displaced between a stationary and an adjustable stop or abutment and an adjustable stop or abutment member.

This heretofore known device has a primary disadvantage, disregarding the production thereof, which is its rather jerky operation. Fixed stops or abutments are provided, against which a stop or abutment of the outer gear moving at full control speed respectively runs. Due to this running of the outer gear stop against the fixed stops, abrupt or sudden initiation of doctor roller control occurs with maximally high acceleration. The plane gears reverse their direction of rotation at the moment of engagement or abutment. Noises, impacts and a therefrom resulting enormously high loading or stressing of the toothing and of all the components are the result.

In addition, from E. German Pat. No. 18 242 of the Office of Inventions and Patents in East Berlin, there is known a control device for varying the magnitude of the rotary motion of doctor rollers on inking or dampening rollers, wherein a driver or guide rod for the control movement is articulatingly connected to a crank of an externally toothed gear which rolls around a stationary, internally toothed large gear. The externally toothed gear is mounted in a crank lever and is adjustable together with the stationary gear by means of a gear drive, during the operation of the machine, both gears being constructed like an epicyclic gear system (a planetary gear train) whereby one pitch circle rolls around on another pitch circle having double the diameter of the one pitch circle, each peripheral point of the one pitch circle of smaller diameter describing a straight line.

A variation of the foregoing heretofore known device is attained by replacement of the internally toothed stationary gear by an externally toothed spur gear, a twin gear pair meshing with the spur gear and the small rolling gear being provided for the transmission of motion.

With these heretofore known devices, costly design and the consequent expensive construction methods, together with the spatial requirements connected therewith, have a disadvantageous effect. Moreover, the angle of deflection of the lever coupled to the driver or guide rod and which extends from the ratchet gear that is seated on the doctor roller journal pin and drives the same, is not adjustable to zero degrees.

There is also known from E. German Pat. No. 25 345 of the Office of Inventions and Patents in East Berlin, a device for infinitely (steplessly) controlling variation in the angle of rotation of the doctor roller from 0° to 90° in printing machines. This heretofore known device is formed of a coupling gear that is movable by a crank drive with an input and an output drive rocker arm, the location-changing swing or oscillation point of the output drive rocker arm being adjustable by means of a pinion which runs around on a toothed segment. The movement of the doctor roller occurs through a control lever disposed coaxially thereto, the control lever being, in turn, driven by an output drive coupler having a common articulating point with the output drive rocker arm.

The disadvantage of the just-mentioned, heretofore known device lies again in the costly design and construction thereof, as well as in the spatial disposition of the individual rocker arms and coupling members in several planes, because of which a large amount of space is required for installation. Moreover, the incidental tolerances resulting from the large number of joints or articulations have an adverse effect thereon.

It is accordingly an object of the invention, proceeding from the foregoing state of the art, to provide a device for controlling and continuously or infinitely varying the angle of rotation of the doctor roller from 0° to 90° during operation of the machine, wherein all of the control members on the doctor roller journal pin, due to compact assembly thereof, ensure optimal space utilization. Another object of the invention is to provide such a device wherein tolerances are held to a minimum so as to ensure thereby accurate adjustment and quiet running with maximal operational reliability.

With the foregoing and other objects in view, there is provided in accordance with the invention a device for controlling the doctor roller of a printing press comprising control gear means including a first control member rotatably mounted on a reciprocating control lever, a transmission member mounted on a journal pin for the doctor roller and couplable in one direction, and a second control member formed of an adjustable guide cam and a cam follower mounted on the first control member and guidably movable in the guide cam.

In accordance with other features of the invention, the first control member and the transmission member are formed as gears and are either internally or externally toothed. To reduce production costs, the first control member and the transmission member can alternatingly be formed as segments of a gear.

In accordance with a further feature of the invention, a free-wheeling device is interposed between the transmission member and the journal pin.

In accordance with an additional feature of the invention, the guide cam, which is incised or formed in the control disc, has a bipartite cam path formed as epicycloids succeeded by a coaxial circular path.

In accordance with yet another feature of the invention, the guide cam has a circular cam path incorporating two or more circular path parts or sections, one of the circular path parts being coaxial to the doctor roller journal pin, and the other of the circular cam path parts having centers of curvature outside the axis of symmetry of the doctor roller journal pin.

In accordance with an alternate feature of the invention, the guide cam has a single or one-part or one-section cam path of epicycloid form and is rotatably mounted on a pivot pin spaced from the journal pin and is pivotable thereabout into various cam positions.

In accordance with a concomitant feature of the invention, the device of the invention includes a control disc having a gear segment formed thereon and being provided with the guide cam, and a lockable pinion engageable with the gear segment and actuable for adjusting the position of the control disc.

Other features which are considered as characteristic for the invention are set forth in the appended claims.

Although the invention is illustrated and described herein as device for controlling the doctor roller of a printing press, it is nevertheless not intended to be limited to the details shown, since various modifications may be made therein without departing from the spirit of the invention and within the scope and range of equivalents of the claims.

The invention, however, together with additional objects and advantages thereof, will be best understood from the following description when read in connection with the accompanying drawing, in which:

FIG. 1 is a longitudinal view, partly in section and partly broken away, of the device for controlling the doctor roller of a printing press in accordance with the invention;

FIG. 2 is a diagrammatic side view of FIG. 1, wherein a guiding cam having a bipartite cam path is shown in control position for maximal displacement or travel, the doctor roller executing rotation through a maximal angle of 90°;

Figure 3:
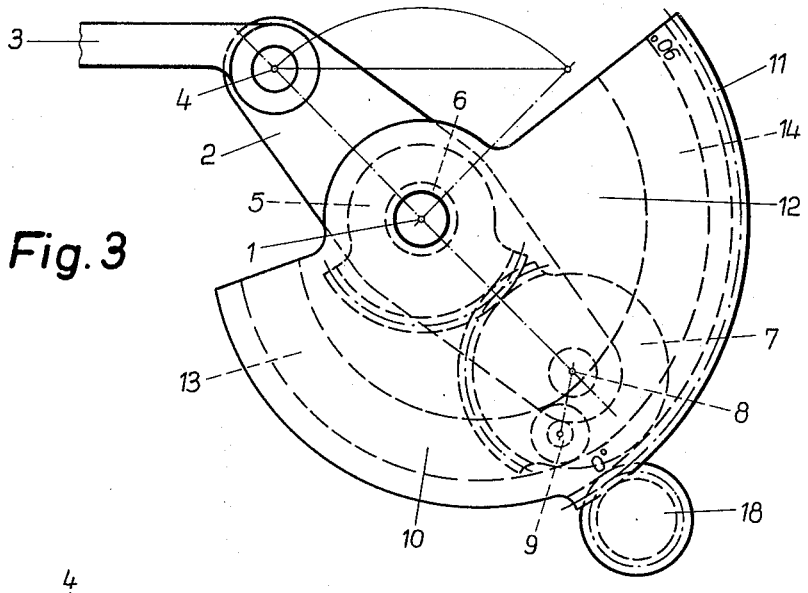
FIG. 3 is a diagrammatic side view of FIG. 1 wherein a guiding cam having a bipartite cam path is shown in control position for minimal displacement or travel, the rotary angle of the doctor roller being 0°.

Referring now to the drawing and first, particularly, to FIG. 1 thereof, there is shown therein a control lever 2 rotatably mounted on a doctor roller journal pin or shaft 1 and driven and continuously reciprocated by a crank drive mechanism 3 which engages the upper end of the control lever 2 and is connected thereto by a pivot pin 4. An externally toothed transmission gear or gear segment 5 is disposed adjacent or in front of the control lever 2, as viewed from the right-hand side of FIG. 1, and is mounted on the doctor roller journal pin 1, with a free-wheeling device 6 interposed. The transmission gear segment 5 is in engagement with a similarly externally-toothed control gear or gear segment 7, which is rotatably mounted on a pivot 8 which is rigidly pinned to the bottom end of the control lever 2, as viewed in FIG. 1. A control roller or cam follower 9 is rotatably mounted on the gear segment 7. It travels in a guide cam 10, 15 of a control disc 12 constructed as a toothed or gear segment 11 which is, in turn, rotatably mounted on the doctor roller journal pin 1. Adjustment of the control disc 12 and, thereby, of the guide cam 10 is effected by a pinion 18 which meshes with the toothed or gear segment 11 of the control disc 12 and is adjustable by means of a non-illustrated handwheel.

In FIG. 2, the device of the invention is shown in control position for maximal displacement or travel. In this adjustment phase of the device of the invention, the guide cam 10 having a bipartite cam path is shifted by means of a pinion 18 so that the control roller or cam follower 9 mounted on the control gear 7, determined by the finite reciprocal movement of the control lever 2, travels only in the circular arcuate area 14 of the guide cam 10 disposed coaxially to the center of rotation of the control lever 2. The control gear 7, which meshes with the transmission gear 5, entrains the control lever 2 without any roll-off movement during the swinging or oscillating motion of the latter and thereby, through the built-in free-wheeling device 6, effects a turning of the doctor roller shaft 1 through an angle of about 90° intermittently in one rotary direction.

In FIG. 3, the zero setting of the rotary angle of the doctor roller shaft 1 and consequently, the standstill or stationary phase thereof is shown. The guide cam 10 with bipartite cam path of the control disc 12 is adjusted or set so that the control roller or cam follower 9 travels only in epicyclic region 13 of the guide cam 10. The control gear 7 thereby rolls around the transmission gear 5 coupled to the doctor roller journal pin 1 without moving the transmission gear 5 per se.

Figure 4:
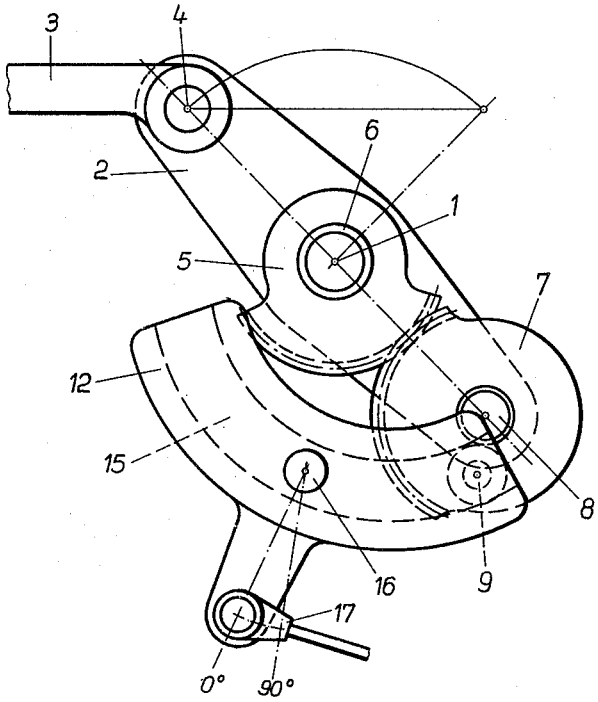
FIG. 4 is a diagrammatic side view of FIG. 1 wherein a guiding cam has a one-part cam path in the form of an epicycloid.

In FIG. 4, there is shown an embodiment of the guide cam having a one-part cam path 15 formed as an epicycloid. The control disc 12 with the guide cam 15 disposed therein is mounted, in mounted, embodiment of FIG. 4, not coaxially on and around the doctor roller journal pin 1 but rather on a rotary center or pivot 16 disposed eccentrically on the housing. The control disc 12 is pivotable into varying cam positions by means of an adjusting mechanism 17. When guide cam 15 is pivoted from the epicycloid into the circular arcuate regions, the center of the epicycloid guide cam 15 approaches the center of the doctor roller journal pin 1, until nearly a circular path has been formed therearound. In this maximal operating position, the control gear 7 actuates the transmission gear 5 so that it turns intermittently in one rotary direction through a rotary angle of about 90°. It should be noted in this regard that, due to the epicycloidal construction of the cam 10, the angular velocity of the transmission gear 5 and accordingly of the doctor roller journal pin 1 is non-uniform. Since this slightly non-uniform or irregular rotary movement is continuously executed, in turn, it has no effect upon the transporting travel or stroke of the doctor roller.

By reversing the foregoing process, i.e. swinging or pivoting the guide cam 15 about the eccentric rotary center 16 into the epicycloid region, the control position for minimal stroke or travel and, consequently, standstill of the doctor roller 1 are attained. The control gear segment 7 rolls around on the transmission gear segment 5 without moving the latter.

I claim:

1. Device for controlling the doctor roller of a printing press comprising an oscillating control lever, a control member formed with at least part of a gear rotatably mounted on said control lever, a transmission member formed with at least part of a gear mounted on a shaft for the doctor roller and means for rotating said transmission member relative to the shaft in one rotary direction, and for preventing rotation of said transmission member in the other rotary direction, said transmission member being couplable with the shaft for rotation therewith in the other rotary direction, the gear parts of said control member and said transmission member being in meshing engagement with one another, a pivotally mounted control disc formed with an guide cam, and a control roller rotatably mounted on said first rotary member and guidably movable on said guide cam.

2. Device according to claim 1 wherein said gear wheel part is externally toothed.

3. Device according to claim 1 including a free-wheeling device interposed between said transmission member and said doctor roller shaft.

4. Device according to claim 1 wherein said guide cam has a bipartite cam path formed as an epicycloid path and an adjacent circular path.

5. Device according to claim 1 wherein said guide cam has a circular cam path formed with a plurality of parts, one of said circular cam path parts extending coaxially to said doctor roller shaft, the other of said circular cam path parts having a center of curvature located outside the axis of said shaft.

6. Device according to claim 1, wherein said guide cam has a one-part cam path formed as an epicycloid, and a pivot pin spaced from said shaft, said guide cam being rotatably mounted on said pivot pin and being pivotable thereabout into various cam positions.

7. Device according to claim 1, wherein said control disc has a gear segment formed thereon is, and including a lockable pinion engageable with said control disc gear segment and actuable for adjusting the position of said control disc.

* * * * *